US010850526B2

(12) United States Patent
Ueno

(10) Patent No.: US 10,850,526 B2
(45) Date of Patent: Dec. 1, 2020

(54) CAP, INK CONTAINER AND IMAGE FORMING APPARATUS

(71) Applicant: KYOCERA Document Solutions Inc., Osaka (JP)

(72) Inventor: Daijiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/440,324

(22) Filed: Jun. 13, 2019

(65) Prior Publication Data

US 2019/0381799 A1 Dec. 19, 2019

(30) Foreign Application Priority Data

Jun. 14, 2018 (JP) ..... 2018-113621

(51) Int. Cl.
*B41J 2/175* (2006.01)

(52) U.S. Cl.
CPC ..... *B41J 2/1754* (2013.01); *B41J 2/17513* (2013.01); *B41J 2/17523* (2013.01); *B41J 2/17596* (2013.01); *B41J 2002/17516* (2013.01)

(58) Field of Classification Search
CPC .. B41J 2/1754; B41J 2/17513; B41J 2/17596; B41J 2/17523; B41J 2/17553; B41J 2002/17516
See application file for complete search history.

(56) References Cited

U.S. PATENT DOCUMENTS

| | | | | |
|---|---|---|---|---|
| 6,276,788 | B1 | 8/2001 | Hilton | |
| 9,623,664 | B2 | 4/2017 | Maeshima | |
| 9,827,775 | B2 | 11/2017 | Arimura | |
| 2005/0115616 | A1* | 6/2005 | Mackal | F16K 15/20 137/540 |

(Continued)

FOREIGN PATENT DOCUMENTS

| | | | |
|---|---|---|---|
| CN | 1205273 | A | 1/1999 |
| JP | 2014213565 | A | 11/2014 |

(Continued)

OTHER PUBLICATIONS

The extended European search report issued by the European Patent Office dated Jun. 26, 2019, which corresponds to European Patent Application No. 19156357.6-1019 and is related to U.S. Appl. No. 16/440,324.

(Continued)

*Primary Examiner* — Scott A Richmond
(74) *Attorney, Agent, or Firm* — Studebaker & Brackett PC

(57) ABSTRACT

A cap includes a cap body and a check valve. The cap body is attached to a spout of an ink container supplying an ink to one direction. The check valve has a check valve ball inside and prevents backward flow of the ink to the other direction. The cap body includes a first thread portion, a supplying port and a second thread portion. The first thread portion is screwed with an outer circumference face of the spout to seal the spout. The supplying port is provided inside the first thread portion and has an inner diameter smaller than the spout. The second thread portion is provided around the supplying port inside the spout. The check valve is screwed with the second thread portion.

12 Claims, 9 Drawing Sheets

(56) References Cited

U.S. PATENT DOCUMENTS

2007/0007306 A1* 1/2007 Lin ..... G01F 11/025
222/321.7
2019/0134986 A1* 5/2019 Johnson ..... B41J 2/1754

FOREIGN PATENT DOCUMENTS

WO 2015079855 A1 6/2015
WO 2017014779 A1 1/2017

OTHER PUBLICATIONS

An Office Action mailed by the State Intellectual Property Office of the People's Republic of China dated Jul. 3, 2020, which corresponds to Chinese Patent Application No. 201811316627.2 and is related to U.S. Appl. No. 16/440,324; with English language translation.

An Office Action mailed by the State Intellectual Property Office of the People's Republic of China dated Sep. 14, 2020, which corresponds to Chinese Patent Application No. 201910500752.7 and is related to U.S. Appl. No. 16/440,324; with English language translation.

* cited by examiner

CAP, INK CONTAINER AND IMAGE FORMING APPARATUS

INCORPORATION BY REFERENCE

This application is based on and claims the benefit of priority from Japanese Patent application No. 2018-113621 filed on Jun. 14, 2018, the entire contents of which are incorporated herein by reference.

BACKGROUND

The present disclosure relates to a cap attached to an ink container, the ink container including this cap, and an image forming apparatus including this ink container.

Conventionally, an ink-jet type image forming apparatus ejects an ink to a recording medium, such as a sheet, by a recording head to form an image. The image forming apparatus includes an ink container containing an ink to supply the ink from the ink container to a recording head.

For example, a liquid bag (an ink pack) of the ink container may include a liquid containing part containing the ink, and a spout having a passage being opened/closed in accordance with relative attachment/detachment of a connected object as a supplied destination of the ink contained in the liquid containing part. The spout has a contact face and a liquid gap. The contact face is opened at an opening communicating to the passage and comes into contact with the connected object when the ink container is attached to the connected object. The liquid gap is recessed in the contact face and guides and keeps the ink adhered to the opening when the ink container is detached from the connected object.

For example, a sub ink tank is located above the recording head and the ink container. The sub ink tank continuously supplies the ink of an amount corresponding to ejection of the ink from the recording head during printing operation. The image forming apparatus controls to supply the ink from the ink container to the sub ink tank by a pump in order to constantly store the ink of a predetermined amount.

When the printing operation is stopped, ink supply from the ink container to the sub ink tank is also stopped. Due to reaction of stop of ink supply, the ink is flowed backwardly from the sub ink tank or the pump to the ink container. In order to prevent such ink backward flow, the image forming apparatus needs to include a check valve between the ink container and the sub ink tank. Conventionally, if the check valve is provided in the ink container, it is feared that ink leakage occurs and the ink container is enlarged.

SUMMARY

In accordance with the present disclosure, a cap includes a cap body and a check valve. The cap body is attached to a spout of an ink container supplying an ink to one direction. The check valve has a check valve ball inside and prevents backward flow of the ink to the other direction. The cap body includes a first thread portion, a supplying port and a second thread portion. The first thread portion is screwed with an outer circumference face of the spout to seal the spout. The supplying port is provided inside the first thread portion and has an inner diameter smaller than the spout. The second thread portion is provided around the supplying port inside the spout. The check valve is screwed with the second thread portion.

In accordance with the present disclosure, an ink container includes the cap described above, the spout, and an ink pack integrally constituted with the spout to contain the ink.

In accordance with the present disclosure, an image forming apparatus includes the ink container described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, entire structure of a printer 1 as an ink-jet type image forming apparatus 1 will be described with reference to FIGS. 1 and 2. Hereinafter, for convenience of description, it will be described so that the front side of the printer 1 is positioned at a near side on a paper sheet of FIG. 1. Arrows Fr, Rr, L, R, U and Lo in each of the drawings respectively indicate a front side, a rear side, a left side, a right side, an upper side and a lower side of the printer 1.

Figure 1:
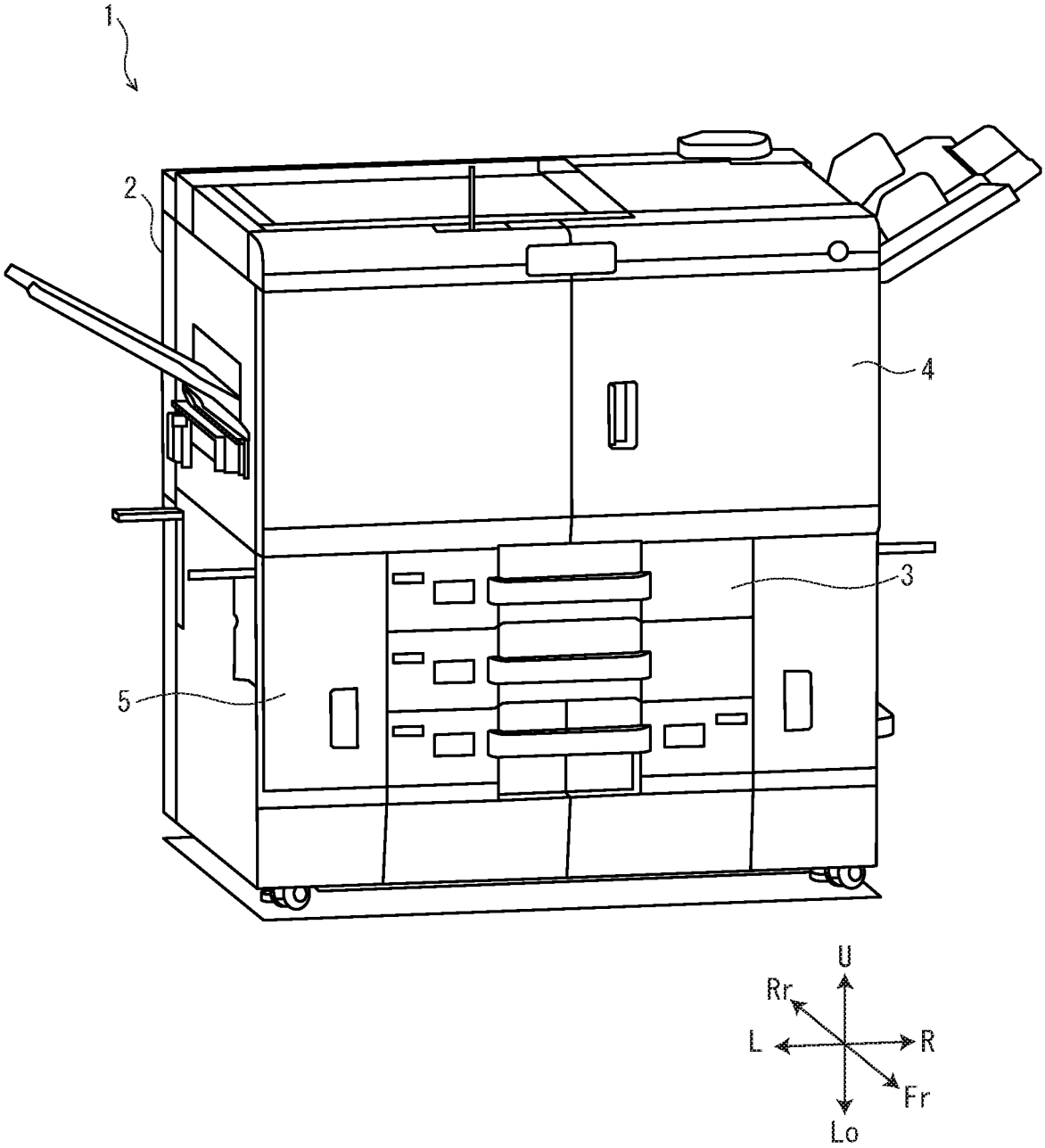
FIG. 1 is a perspective view showing a printer according to an embodiment of the present disclosure.
Figure 2:
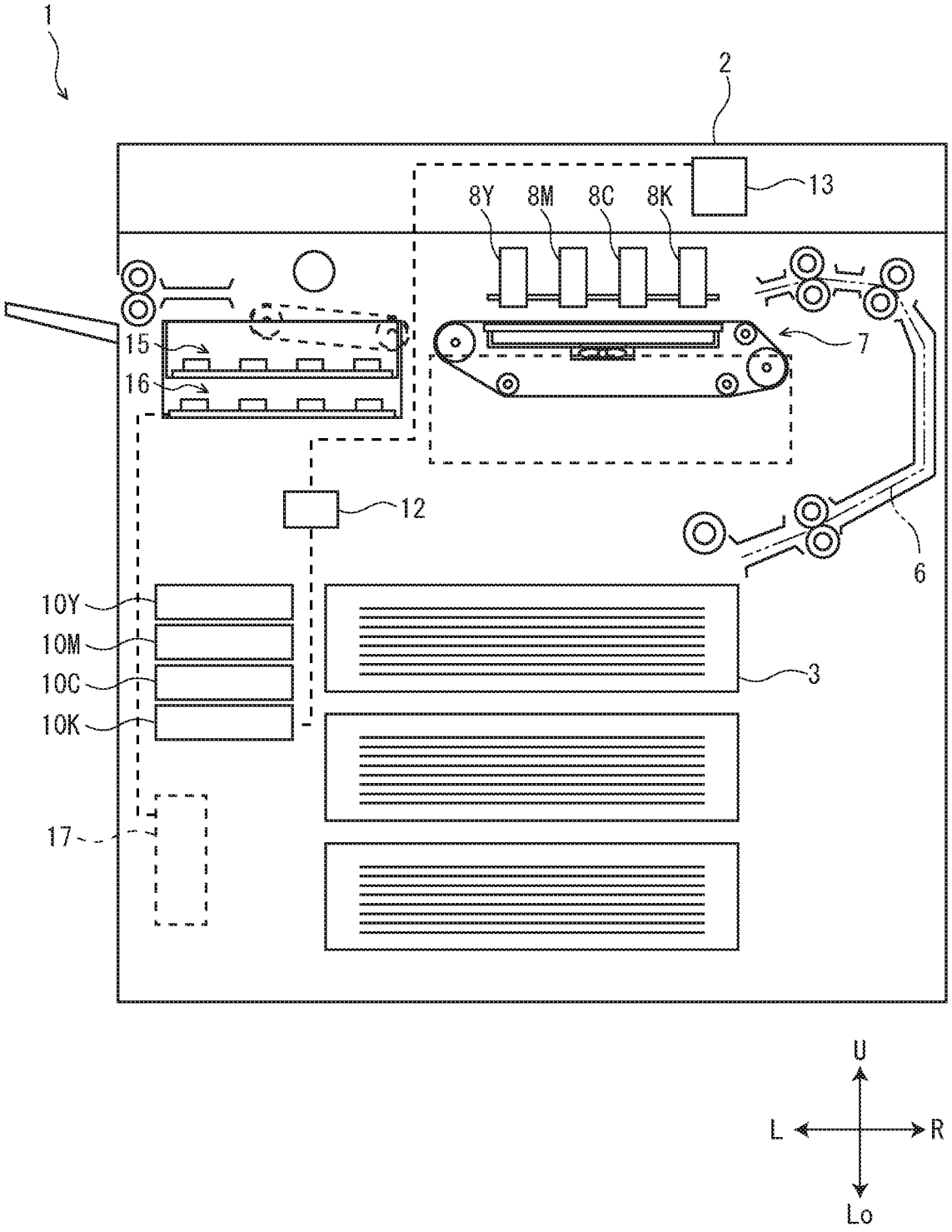
FIG. 2 is a sectional view schematically showing the printer according to an embodiment of the present disclosure.

As shown in FIGS. 1 and 2, the printer 1 includes a box-shape printer body 2. In a lower part of the printer body 2, a sheet feeding cartridge 3 storing sheets is drawably housed.

Figure 3:
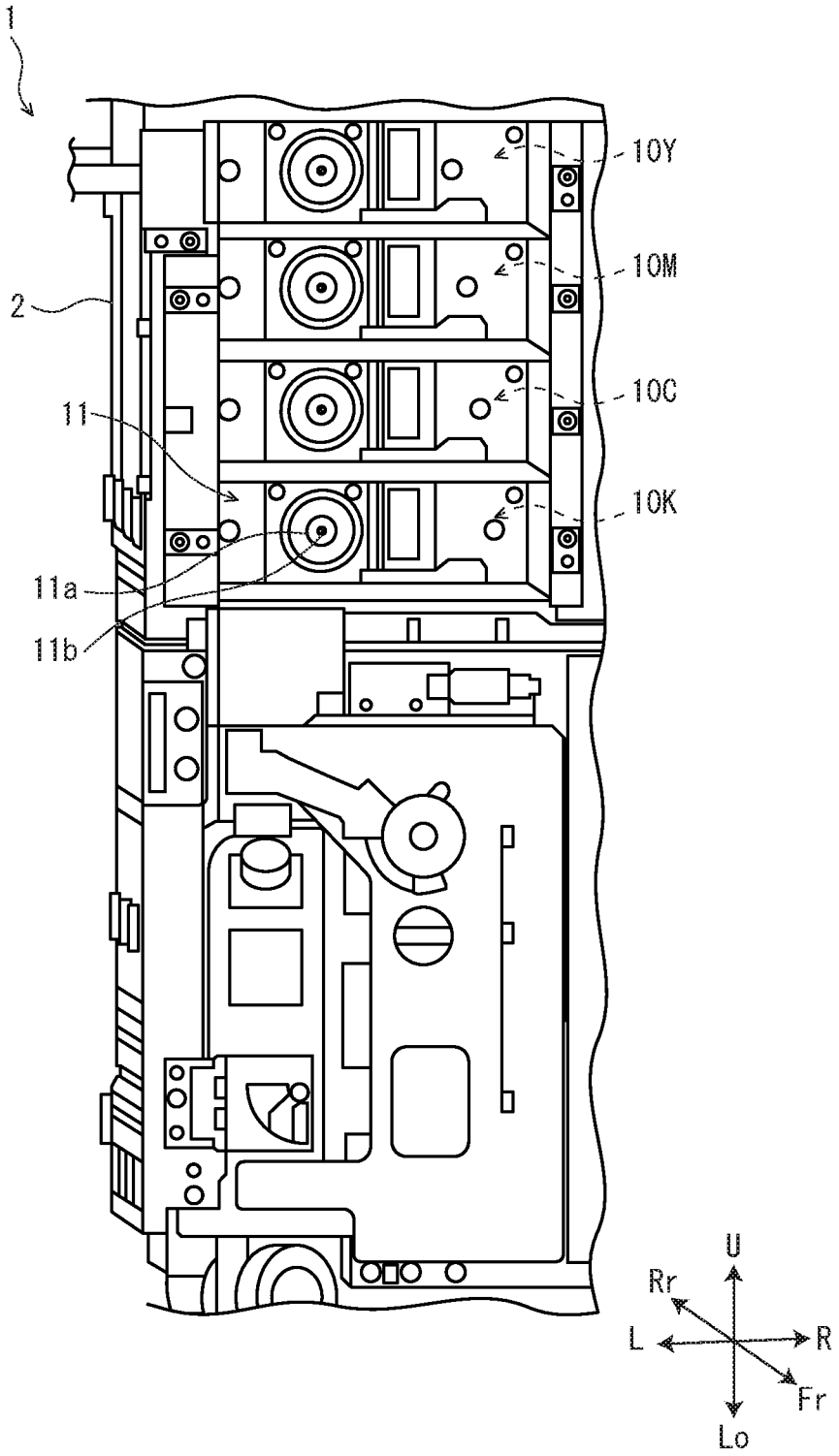
FIG. 3 is a sectional view showing the inside of a left lower part of the printer according to an embodiment of the present disclosure.

In a front face of the printer body 2, an upper side cover 4 and a left lower side cover 5 are openably/closably provided. When the upper side cover 4 is opened, a sheet conveying unit 7, a cap unit 15 and a wiper unit 16 described below become in states capable of maintenance. Moreover, as shown in FIG. 3, when the left lower side cover 5 is opened, ink containers 10 and a waste ink tank 17 described below become in states capable of replacement.

In a right part inside the printer body 2, a conveyance path 6 of the sheet is arranged and, in a center part inside the printer body 2, the sheet conveying unit 7 is ascendably/ descendably arranged above the sheet feeding cartridge 3. The conveyance path 6 is provided from the sheet feeding cartridge 3 to the sheet conveying unit 7 and, along a conveying direction of the sheet through the conveyance path 6, a sheet feeding roller, a conveying roller and a registration roller are located in sequential order from an upstream side.

The sheet conveying unit 7 includes a conveying frame and an endless conveying belt and is configured to ascent/descent in upward and downward directions between a print position close to recording heads 8 described below in printing operation and an evacuation position separate from the recording heads 8 in non-printing operation. To the conveying frame, a driving roller, a following roller and a tensioning roller are rotatably arranged and the conveying belt is wound around the driving roller, the following roller and the tensioning roller so as to convey the sheet from a right side to a left side. Inside the conveying belt, an air sucking part is arranged. In the conveying belt, a lot of air intake holes are provided and the air sucking part sucks air above the conveying belt to the inside the conveying belt.

In a left part inside the printer body 2, a sheet conveying part, a drying part and an ejecting roller are arranged at a left side from the sheet conveying unit 7 at the print position in order to eject the sheet after printing. In a left face of the printer body 2, an ejecting port is formed in the vicinity of the ejecting roller and, below the ejecting port, an ejected sheet tray is arranged so as to protrude to a left side.

Moreover, in a center part inside the printer body 2, four recording heads 8 (8K, 8C, 8M, 8Y) are juxtaposed above the sheet conveying unit 7. The four recording heads 8 face to an upper face of the conveying belt of the sheet conveying unit 7 in the printing operation to eject inks of black, cyan, magenta and yellow, respectively. For example, the four recording heads 8 are located, as shown in FIG. 2, in sequential order from an upstream side in the conveying direction of the sheet. For example, in each recording head 8, a lot of nozzles are juxtaposed along forward and backward directions.

In a left lower part inside the printer body 2, four ink containers 10 (10K, 10C, 10M, 10Y) are juxtaposed. The four ink containers 10 contain inks of black, cyan, magenta and yellow, respectively. For example, the four ink containers 10 are located in sequential order from a lower side. When the left lower side cover 5 is opened, as shown in FIG. 3, container installed parts 11 of the respective ink containers 10 arranged in the left lower part inside the printer body 2 are exposed and the respective ink containers 10 become in states attachable/detachable with respect to the respective container installed parts 11 in the forward and backward directions.

In the embodiment, the front side of the printer 1 is a near side (one end of the ink container 10) in an installing direction of the ink container 10 to the container installed part 11. The rear side of the printer 1 is a far side (other end of the ink container 10) in the installing direction of the ink container 10 to the container installed part 11.

At the far side of each container installed part 11, a connected port 11*a* connected to the corresponding ink container 10 is provided and the connected port 11*a* is communicated to an ink supplying path to a corresponding each of sub ink tanks 13. Inside the connected port 11*a*, a needle 11*b* extended in the forward and backward directions is provided. The connected port 11*a* has an inner diameter fitting a connecting part 37 of a cap 23 of the ink container 10 described below and the needle 11*b* has an outer diameter fitted into the inside of the connecting part 37.

Each ink container 10 is connected to each recording head 8 via each of pumps 12 each of sub ink tanks 13. Each pump 12 is arranged on the ink supplying path between the connected port 11*a* and each sub ink tank 13. Incidentally, although the pumps 12 and the sub ink tanks 13 are provided to correspond to respective ink colors of black, cyan, magenta and yellow similar to the recording heads 8 and the ink containers 10, FIG. 2 illustrates only the pump 12 and the sub ink tank 13 corresponding to black and omits the pumps 12 and the sub ink tanks 13 corresponding to cyan, magenta and yellow.

Each sub ink tank 13 is located above each recording heads 8 and each ink container 10 to store the ink of a predetermined amount and to supply each recording head 8 with the ink of an amount corresponding to ejection of the ink from each recording head 8. The printer 1 controls to supply the ink from each ink container 10 to each sub ink tank 14 by each pump 12 in order to constantly store the ink of the predetermined amount.

In a left upper part of the printer body 2, the cap unit 15 and the wiper unit 16 are provided. The cap unit 15 and the wiper unit 16 are located at waiting positions at a left side from the sheet conveying unit 7 in the printing operation. Moreover, when the sheet conveying unit 7 is positioned at the evacuation position in the non-printing operation, the cap unit 15 and the wiper unit 16 become in states movable in left and right directions, and then, any one of the cap unit 15 and the wiper unit 16 can move a processing position above the sheet conveying unit 7 and below the recording heads 8.

The cap unit 15 includes cam members and covers the recording heads 8 by the cam members when the cap unit 15 is moved to the processing position. The wiper unit 16 includes wiper members and waste ink tray and the wiper members and the waste ink tray are located below the recording heads 8 when the wiper unit 16 is moved to the processing positions. At this time, purge process or cleaning process of the recording heads 8 is carried out and waste ink caused by the purge process and the cleaning process is collected to the waste ink tray.

Moreover, in a left lower part inside the printer body 2, the waste ink tank 17 is arranged below the ink containers 10. The waste ink tank 17 is connected to the waste ink tray of the wiper unit 16 to receive and to store the waste ink caused by the purge process and the cleaning process from the waste ink tray.

Next, the printing operation (image forming operation) of the printer 1 having such a configuration will be described. When the printer 1 receives image data from an external computer or the like, the sheet stored in the sheet feeding cartridge 3 is picked up and fed to the conveying path 6 by the sheet feeding roller. The sheet fed to the conveying path 6 is conveyed to a downstream side of the conveying path 6 by the conveying roller, and then, fed from the conveying path 6 to the upper face of the conveyance belt of the sheet conveying unit 7 at the print position by the registration roller. The sheet is absorbed to the upper face of the conveyance belt by suction force of the air sucking part.

On the other hand, to each recording head 8, the ink is supplied from each ink container 10. Each recording head 8 ejects the ink to the sheet absorbed on the conveying belt on the basis of the information of the image data received from the external computer or the like. Thereby, a color ink image is formed on a surface of the sheet. The sheet having the color ink image is conveyed by the sheet conveying part, the ink on the surface is dried by the drying device, and then, the sheet is ejected on the ejected sheet tray via the ejecting port by the ejecting roller.

Next, the ink containers 10 will be described. Since four ink containers 10K, 10C, 10M, 10Y have similar structures, one of the ink containers 10 will be described hereinafter. In the embodiment, since the ink container 10 is installed toward the far side (the rear side) of the container installed part 11 to supply the ink to the rear side (one direction), it is described so that the rear side of the ink containers 10 is a distal end side and the front side of the ink containers 10 is a proximal end side.

Figure 4:
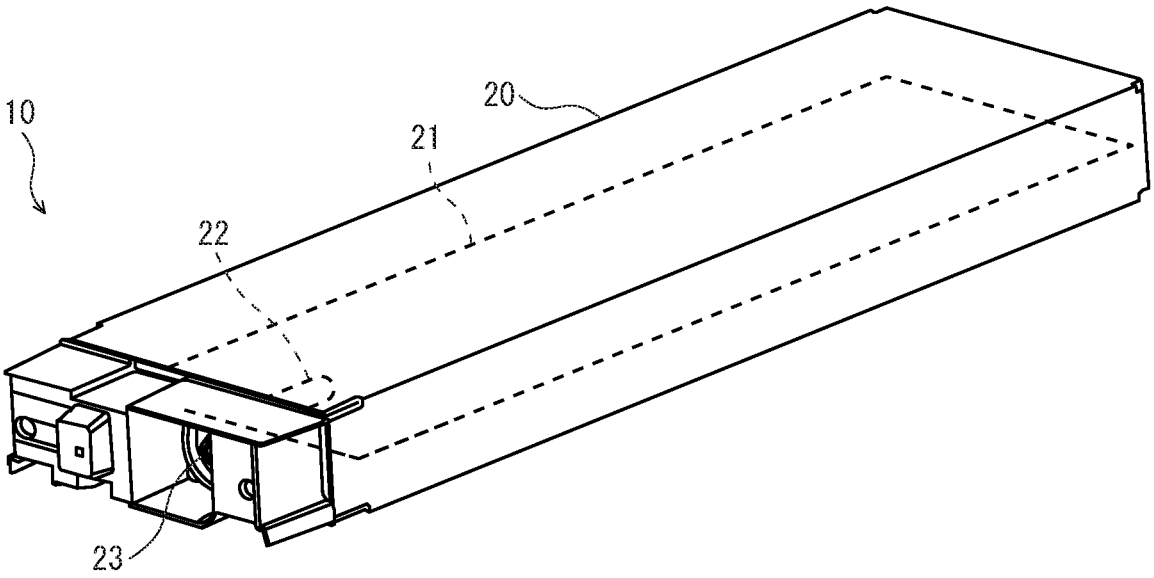
FIG. 4 is a perspective view showing an ink container of the printer according to an embodiment of the present disclosure.
Figure 4:
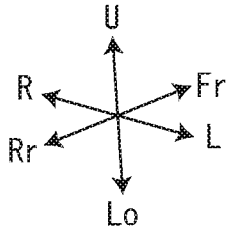
Figure 5:
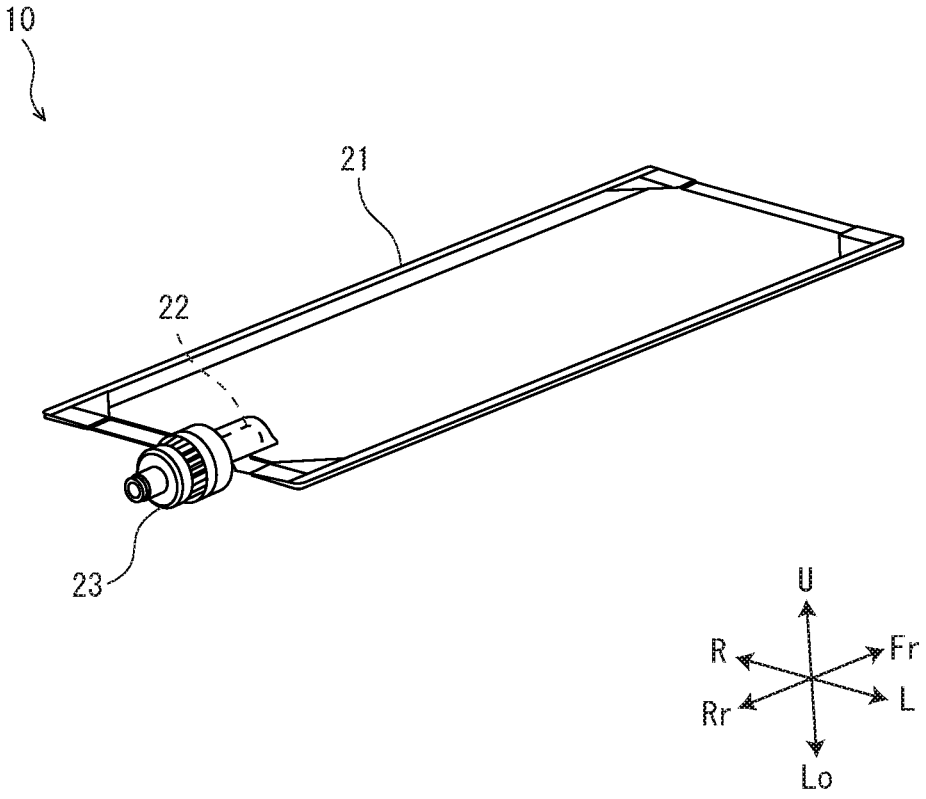
FIG. 5 is a perspective view showing an ink pack and a cap in the ink container according to an embodiment of the present disclosure.

The ink container 10 includes, as shown in FIGS. 4 and 5, a case 20, an ink pack 21 containing the ink, a spout 22 attached to the ink pack 21 and the cap 23 closing the spout 22. Although the ink pack 21 and the spout 22 are individual components, the ink pack 21 and the spout 22 are integrally constituted. The ink container 10 supplies the ink in a state that the cap 23 is attached.

The case 20 is formed in a rectangular parallelepiped box-shape elongated in the forward and backward directions and has a shape capable of being installed into the container installed part 11. Inside the case 20, the ink pack 21 is installed over the forward and backward directions and, at the distal end side inside the case 20, the spout 22 and the cap 23 are installed. A distal end of the case 20 is opened in order to expose the cap 23 connected to the connected port 11*a* of the container installed part 11.

The ink pack 21 is formed in a gusset type bag-shape elongated in the forward and backward directions so as to seal the ink in a vacuum state. The ink pack 21 is made of a film member having flexibility (elasticity). This film member is made by laminating materials, such as plastics and aluminum, in at least two layers or more. For example, in sequential order from a surface side, polyester, aluminum, nylon, and low density polyethylene are laminated. By employing polyester for a surface layer, appearance and strength of the ink pack 21 is improved. By employing a layer of aluminum, a gas barrier property of the ink pack 21 is improved and a preservation property of the ink is enhanced. By employing a layer of nylon, mechanical strength and impact resistance of the ink pack 21 is improved. By employing low density polyethylene or polypropylene for a back face layer (an innermost face layer), welding strength exerted when the film member is formed in the bag-shape by welding is increased, and a sealing property is improved.

The ink pack 21 is configured, for example, so that a pair of side films having gussets are provided between a planar upper film and a planar lower film on both sides. Each side film is folded back along a centerline in the left and right directions, and respective facing inner faces of a distal edge and a proximal edge are welded, and the side films are configured to be expandable in the upward and downward directions. In the upper film and the lower film, respective distal ends are mutually welded together with the spout 22, respective proximal ends are mutually welded, and respective side edges are mutually welded with each side film. Thereby, liquid tightness of the ink pack 21 is ensured.

If the inside of the ink pack 21 is inflated as the ink is charged in the ink pack 21, folding of each side film of the ink pack 21 is expanded and each side film is erected, and thereby, the upper film and the lower film of the ink pack 21 are separated from each other. At this time, front parts and rear parts of the upper film and the lower film are inclined, and a length of the ink pack 21 is decreased. Moreover, if the inside of the ink pack 21 is contracted as the ink is discharged from the ink pack 21, each side film is folded along the folding, and thereby, the upper film and the lower film are approached each other, and the length of the ink pack 21 is extended.

Figure 6:
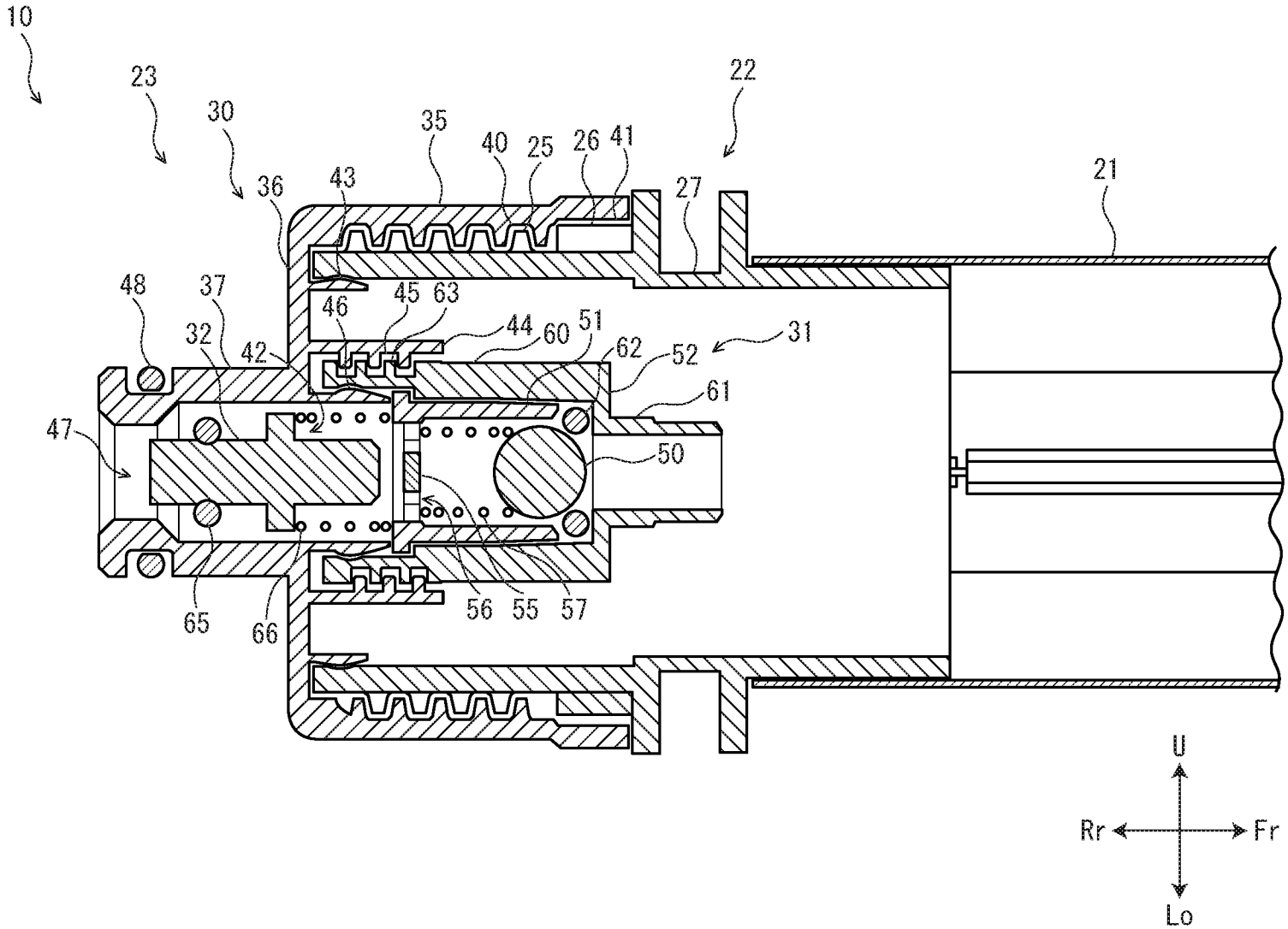
FIG. 6 is a sectional view showing the cap in the ink container according to an embodiment of the present disclosure.

The spout 22 is formed in a cylindrical shape elongated in the forward and backward directions, and has, as shown in FIG. 6, a first external thread 25, and an engaging projected part 26 and a fixing part 27. A proximal end of the spout 22 is located at a center between distal ends of the upper film and the lower film of the ink pack 21 and a distal end of the spout 22 is exposed from the ink pack 21. Incidentally, although the proximal end of the spout 22 is welded together with the upper film and the lower film, opening of the proximal end is communicated to an internal space of the ink pack 21 without being closed by welding.

In an outer circumference face of the spout 22, the first external thread 25 is formed at its distal end, the engaging projected part 26 is formed at the proximal end side from the first external thread 25, and the fixing part 27 is formed at the proximal end side from the engaging projected part 26. The engaging projected part is constituted by a claw or the like facing to an opening direction of the first external thread 25. When the fixing part 27 is fixed to the case 20, the spout 22 is fixed to the case 20.

The cap 23 includes, as shown in FIG. 6, a cap body 30, a check valve 31 and a joint 32.

Figure 7:
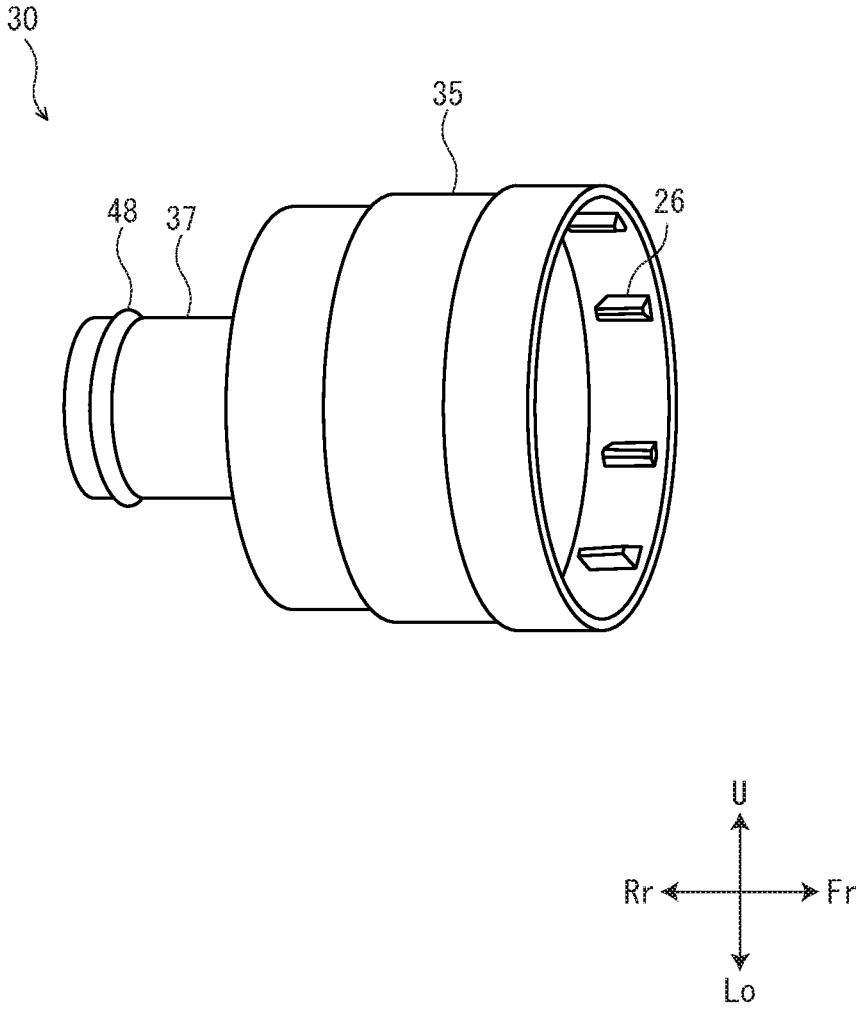
FIG. 7 is a perspective view showing a cap body of the cap in the ink container according to an embodiment of the present disclosure.

The cap body 30 is integrally formed, as shown in FIGS. 6 and 7, to continuously have a first thread portion 35, a lid portion 36 and a connecting portion 37.

The first thread portion 35 is formed in a cylindrical shape elongated in the forward and backward directions, and has an inner diameter slightly larger than an outer diameter of the spout 22 to house the check valve 31 inside. On an inner circumference face of the first thread portion 35, a first internal thread 40 screwed with the first external thread 25 of the spout 22 is formed. When the cap 23 is rotated in a closing direction with respect to the spout 22, the first external thread 25 and the first internal thread 40 are screwed with each other and the cap 23 is attached to the spout 22. Moreover, on a proximal end of the inner circumference face of the first thread portion 35, an engaging recessed part 41 corresponding to the engaging projected part 26 of the spout 22 is formed, when the engaging projected part 26 is inserted into the engaging recessed part 41, rotation of the cap 23 in the opening direction with respect to the spout 22 is prevented.

The lid portion 36 is continued to a distal end of the first thread portion 35 and is formed in an annular shape having the same outer diameter as the first thread portion 35. At a center (an inward side of the first thread portion 35) of the lid portion 36, an inside supplying port 42 (a supplying port) having an inner diameter smaller than an inner diameter of the spout 22 is provided.

On an inner face at the proximal end side of the lid portion 36, an annular seal 43 is provided at a slightly inward side from the first thread portion 35. When the first external thread 25 and the first internal thread 40 are screwed with each other, the distal end of the spout 22 is inserted between the first thread portion 35 and the seal 43 and comes into close contact with the seal 43, and thereby, opening of the spout 22 is sealed by the first thread portion 35. Accordingly, ink leakage between the spout 22 and the first thread portion 35 is prevented.

Moreover, on an inner face of the lid portion 36, a cylindrical second thread portion 44 extended from the circumference of the inside supplying port 42 to the proximal end side. The second thread portion 44 has an outer diameter smaller than the inner diameter of the spout 22 and has an inner diameter slightly larger than an outer diameter of a distal end of the check valve 31 (a first tube portion 60 of a second supporting member 52). On an inner circumference face of the second thread portion 44, a second internal thread 45 screwed with a second external thread 63 of the check valve 31 is formed. When the check valve 31 is rotated in the closing direction with respect to the cap 23, the second external thread 63 and the second internal thread 45 are screwed with each other and the check valve 31 is attached to the cap 23. When the cap 23, to which the check valve 31 is attached, is attached to the spout 22, the second thread and the check valve 31 inside the cap body 30 are housed inside the spout 22.

Further, on the inner face of the lid portion 36, an annular seal 46 is provided at a slightly inward side from the second thread portion 44. When the second external thread 63 and the second internal thread 44 are screwed with each other, the distal end of the check valve (the first tube portion 60 of the second supporting member 52) is inserted between the second thread portion 44 and the seal 46 and comes into close contact with the seal 46, and thereby, the distal end of the check valve 31 is sealed by the second thread portion 44. Accordingly, ink leakage between the distal end of the check valve 31 and the second thread portion 44 is prevented.

The connecting portion 37 is formed in a cylindrical shape extended from the circumference of the inside supplying port 42 to the distal end side on an external face at the distal end side of the lid portion 36 and has the same inner diameter as the inside supplying port 42 to house the joint 32 inside. Incidentally, in the distal end of the connecting portion 37, an outside supplying port 47 having an inner diameter reduced from the inside supplying port 42 is provided and the outside supplying port 47 is formed so as to be capable of fitting the needle 11*b* of the container installed part 11.

Moreover, the distal end of the connecting portion 37 has an outer diameter fitted into the connected port 11*a* of the container installed part 11 and, on a distal end of an outer circumference face of the connecting portion 37, an annular seal 48, such as packing, is provided. When the connecting portion 37 is fitted into the connected port 11*a*, the seal 48 comes into contact with an inner circumference face of the connected port 11*a*, and then, the outer circumference face of the connecting portion 37 and the inner circumference face of the connected port 11*a* are sealed. Accordingly, ink leakage between the connecting portion 37 and the connected port 11*a* is prevented.

The check valve 31 includes a check valve ball 50, a first supporting member 51 and the second supporting member 52.

Figure 9:
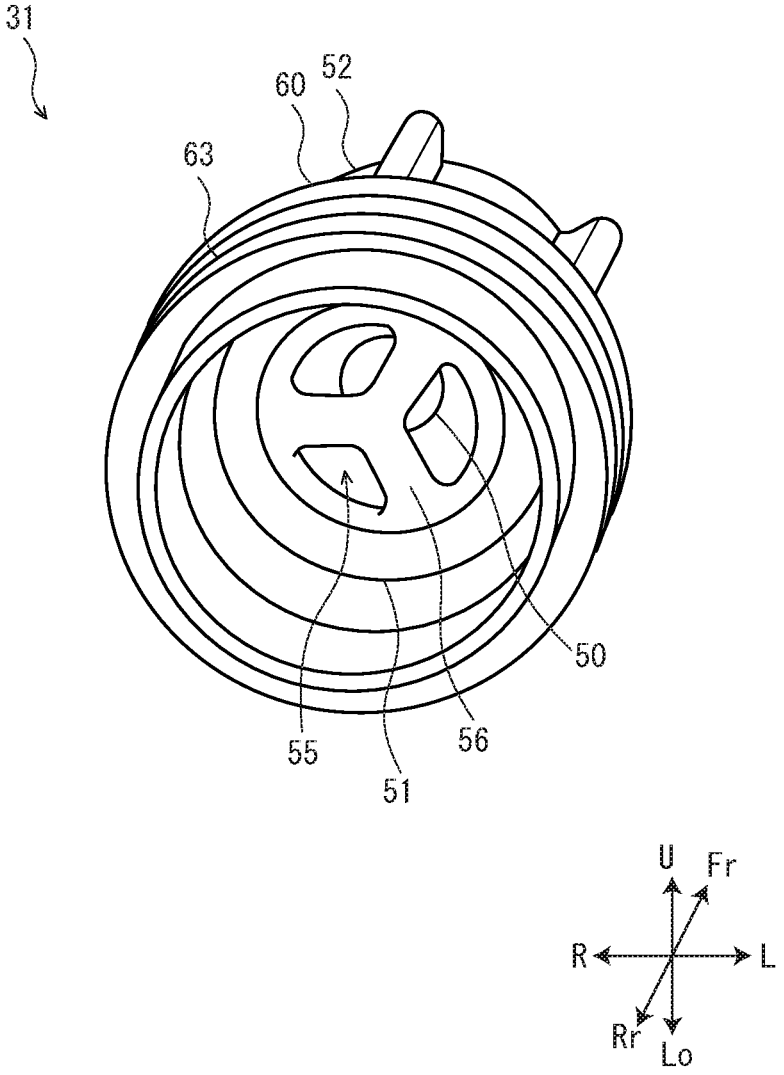
FIG. 9 is a perspective view showing the check valve of the cap, as viewed from a rear side, in the ink container according to an embodiment of the present disclosure.

The first supporting member 51 is formed in a cylindrical shape elongated in the forward and backward directions and, inside the first supporting member 51, as shown in FIGS. 6 and 9, the check valve ball 50 is housed so as to be movable in the forward and backward directions. In a distal end of the first supporting member 51, a communicating portion 55 is provided and a proximal end of the first supporting member 51 is opened. The communicating portion 55 is formed in a latticed-shape or a meshed-shape, for example, with a trifurcated lattice to restrict movement of the check valve ball 50 toward the distal end side and to have a flowing port 56 for the ink. Inside the first supporting member 51, between the communicating portion 55 and the check valve ball 50, a ball biasing spring 57 is provided to bias the check valve ball 50 toward the proximal end side.

Figure 8:
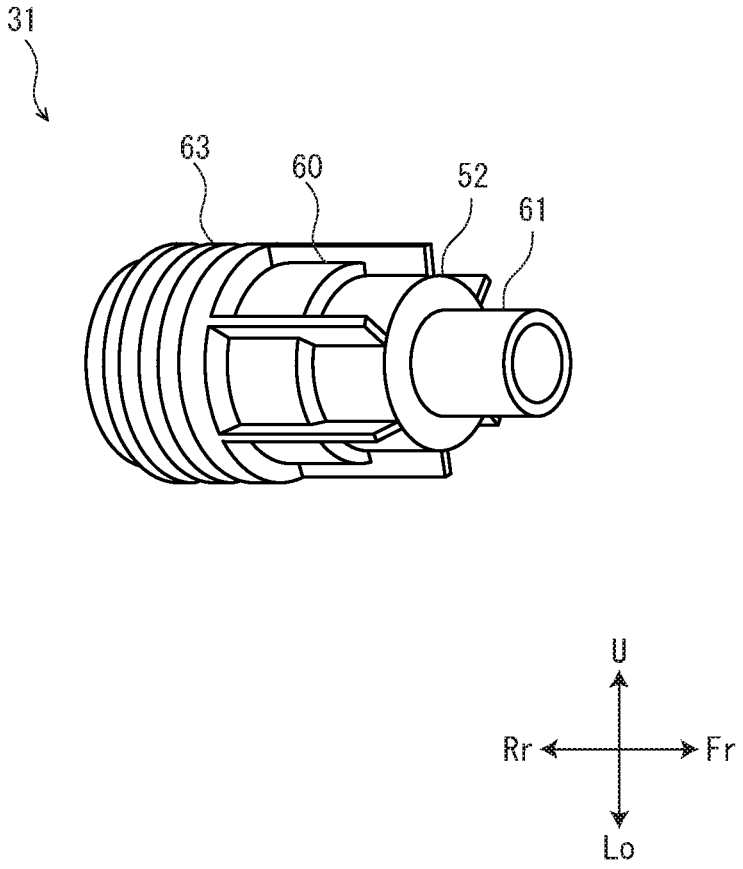
FIG. 8 is a perspective view showing a check valve of the cap, as viewed from a lateral side, in the ink container according to an embodiment of the present disclosure.

The second supporting member 52 is formed, as shown in FIGS. 6 and 8, in a cylindrical shape elongated in the forward and backward directions and is composed of the first tube portion 60 housing the first supporting member 51 and a second tube portion 61 having an inner diameter smaller than the first tube portion 60. The first tube portion 60 and the second tube portion 61 are continued to each other and are integrally formed.

A length in the forward and backward directions of the first tube portion 60 is longer than the first supporting member 51 and, inside the first tube portion 60, the first supporting member 51 and an annular seal 62, such as packing, are housed. The seal 62 has an inner diameter smaller than a diameter of the check valve ball 50, is put between the first supporting member 51 and the second tube portion 61, and restricts movement of the check valve ball 50 toward the proximal end side.

A distal end of the first tube portion 60 is a distal end of the second supporting member 52, i.e. the check valve 31 and, on a distal end of an outer circumference face of the first tube portion 60, the second external thread 63 is formed. A proximal end of the first tube portion 60 is a proximal end of the second supporting member 52, i.e. the check valve 31 and is opened to communicate to the spout 22.

When the check valve 31 is attached to the cap body 30, the seal 46 along the inside supplying port 42 of the lid portion 36 of the cap body 30 and a joint biasing spring 66 inside the connecting portion 37 are inserted into an inside of the second supporting member 52 from the distal end side. At this time, the first supporting member 51 inside the second supporting member 52 is supported by the seal 46 and the joint biasing spring 66. Moreover, inside the seal 46 along the inside supplying port 42, the flowing port 56 of the first supporting member 51 is communicated to the inside supplying port 42.

In the check valve 31 having a configuration described above, in a case where the check valve ball 50 is biased to the proximal end side, the check valve ball 50 comes into close contact with the seal 60, and thereby, the second tube portion 61 is closed by the check valve ball 50 and the seal 62. In this case, communication of a proximal end of the second tube portion 61 communicated to the spout 22 and the flowing port 56 of the first supporting member 51 communicated to the inside supplying port 42 of the cap body 30 is closed.

Incidentally, when the ink is supplied from the ink container 10 to outside, suction force of the pump 12 acts on cap 23 of the ink container 10 connected to the connected port 11*a* of the container installed part 11. In the cap 23 communicated to the connected port 11*a*, this suction force acts on an internal space of the first supporting member 51 from an internal space of the connecting portion 37 of the cap body 30 via the flowing port 56 of the first supporting member 51 of the check valve 31 to move the check valve ball 50 to the distal end side. Thereby, the proximal end of the second tube portion 61 and the flowing port 56 of the first supporting member 51 are communicated to each other. At this time, the ink supplied from the proximal end of the second tube portion 61 passes around the check valve ball 50 inside the first supporting member 51, is flowed to the distal end side, and is supplied to the flowing port 56.

The joint 32 is formed, as shown in FIG. 6, in a roughly columnar shape elongated in the forward and backward directions. The joint 32 is composed of, for example, a head portion at the distal end side and a leg portion at the proximal end side from the head portion, and the head portion has an outer diameter larger than an outer diameter of the leg portion and smaller than an inner diameter of the distal end of the connecting portion 37. On an outer circumference face of a distal end of the face joint 32, an annular seal 65, such as packing, is provided. The seal 65 has an outer diameter larger than an inner diameter of the outside supplying port 47 of the connecting portion 37.

On a circumference face of the joint 32, a plurality of ribs may be formed at regular intervals and, when the joint is moved in the forward and backward directions inside the connecting portion 37, the ribs is slidingly moved along an inner circumference face of the connecting portion 37. Moreover, to the joint 32, the joint biasing spring 66 is provided so as to wind around the joint 32. The joint biasing spring 66 is located between the joint 32 and the first supporting member 51 of the check valve 31 attached to the cap body 30 to bias the joint 32 with respect to the check valve 31, i.e. the cap body 30 to the distal end side.

The seal 65 of the joint 32 biased to the distal end side comes into close contact with an inner circumference face of the outside supplying port 47 of the connecting portion 37. At this time, communication of the outside supplying port 47 and the inside supplying port 42 of the lid portion 36 of the cap body 30 is closed and the distal end of the connecting portion 37, i.e. the distal end of the cap 23 is closed.

On the other hand, when the cap 23 is attached to the connected port 11*a* of the container installed part 11 and the needle 11*b* is inserted into the outside supplying port 47 of the connecting portion 37, the joint 32 is pressed to the proximal end side by the needle 11*b* against biasing force of the joint biasing spring 66. At this time, close contact of the seal 65 and the outside supplying port 47 is released and, the outside supplying port 47 and the inside supplying port 42 of the cap body 30 are communicated to each other. Thereby, closing of the distal end of the cap 23 is released and, the cap 23 and the connected port 11*a* are communicated to each other. Subsequently, in the connecting portion 37, the ink supplied from the flowing port 56 of the first supporting member 51 passes around the joint 32 inside the connecting portion 37, is flowed to the distal end side, and is supplied to the connected port 11*a*.

As described above, in a case where the cap 23 is not attached to the connected port 11*a*, the outside supplying port 47 of the connecting portion 37 of the cap body 30 is closed by the seal 65 of the joint 32 and the second tube portion 61 of the second supporting member 52 of the check valve 31 is closed by the check valve ball 50 and the seal 62, and thereby, ink leakage is prevented by double closing mechanism.

Moreover, in a case where the cap 23 is attached to the connected port 11*a* and suction of the pump 12 is carried out, closing of the outside supplying port 47 is released and closing of the second tube portion 61 is released, and then, the proximal end of the second tube portion 61 and outside supplying port 47 are communicated to each other and ink supply from the spout 22 to the connected port 11*a* is allowed.

In accordance with the embodiment, as described above, the cap 23 provided in the ink container 10 of the printer 1 includes the cap body 30 and the check valve 31. The cap body 30 is attached to the spout 22 of the ink container 10 supplying the ink to the distal end side (one direction). The check valve 31 has the check valve ball 50 inside and prevents backward flow of the ink to the proximal end side (the other direction). The cap body 30 includes the first thread portion 35, the inside supplying port 42 (supplying port) and the second thread portion 44. The first thread portion 35 is screwed with the outer circumference face of the spout 22 to seal the spout 22. The inside supplying port 42 is provided inside the first thread portion 35 and has the inner diameter smaller than the spout 22. The second thread portion 44 is provided around the inside supplying port 42 inside the spout 22. The check valve 31 is screwed with the second thread portion 44.

According to this, the check valve 31 preventing backward flow of the ink from the recording head 8 and sub ink tank 13 to the inside of the ink pack 21 of the ink container 10 can be provided in the cap 23 of the ink container 10 with the simple configuration without needing to provide at a side of the printer body 2. Since the check valve 31 is attached to the cap 23 by screwing mechanism composed of the second thread portion 44 and the cap 23 is attached to the ink pack 21 by screwing mechanism composed of the first thread portion 35, it is possible to attach the check valve 31 to the ink container 10 by double screwing mechanism. The screwing mechanism composed of the second thread portion 44 can more surely restrain ink leakage in comparison with a case where the check valve 31 is attached by connecting mechanism, such as snap-fit. Since the check valve 31 is housed inside the spout 22 in a state being attached to the cap 23, the ink container 10 is not enlarged.

Although the embodiments was described as example about a case applying the configuration of the present disclosure to the printer 1, the disclosure is not restricted by this example, and the disclosure may be applied to, for example, another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A cap comprising:

a cap body being attached to a spout of an ink container supplying an ink to one direction; and a check valve having a check valve ball inside and preventing backward flow of the ink to the other direction, wherein the cap body includes:

a first thread portion being screwed with an outer circumference face of the spout to seal the spout;

a supplying port being provided inside the first thread portion and having an inner diameter smaller than the spout; and a second thread portion being provided around the supplying port inside the spout, the check valve is screwed with the second thread portion, the cap body includes a seal inside the second thread portion so as to come into close contact with an inner circumference face of an end at a side in the one direction of the check valve screwed to the first thread portion.

2. The cap according to claim 1, wherein the cap body includes a seal inside the first thread portion so as to come into close contact with an inner circumference face of an end at a side in the one direction of the spout screwed to the first thread portion.

3. An ink container comprising:

the cap according to claim 2;

the spout; and an ink pack integrally constituted with the spout to contain the ink.

4. An image forming apparatus comprising:
the ink container according to claim 3.
5. An ink container comprising:
the cap according to claim 1;
the spout; and
an ink pack integrally constituted with the spout to contain the ink.
6. An image forming apparatus comprising:
the ink container according to claim 5.
7. A cap comprising:
a cap body being attached to a spout of an ink container supplying an ink to one direction; and
a check valve having a check valve ball inside and preventing backward flow of the ink to the other direction,
wherein the cap body includes:
a first thread portion being screwed with an outer circumference face of the spout to seal the spout;
a supplying port being provided inside the first thread portion and having an inner diameter smaller than the spout; and
a second thread portion being provided around the supplying port inside the spout,
the check valve is screwed with the second thread portion,
the cap body includes a connecting portion being formed in a cylindrical shape extended from the supplying port to the one direction and housing a columnar joint inside,
the joint is biased to the other direction by a joint biasing spring and a seal provided in an end at a side in the one direction of the joint comes into close contact with an inner circumference face at the side in the one direction of the connecting portion,
the check valve includes:
the check valve ball;
a cylindrical first supporting member housing the check valve ball inside; and
a cylindrical second supporting member communicating to the spout at a side in the other direction and housing the first supporting member inside,
in an end at the side in the one direction of the first supporting member, a communicating portion is provided to restrain movement of the check valve ball to the side in the one direction and to have a flowing port of the ink,
the communicating portion is supported from the side in the one direction by the joint biasing spring,
an end at the side in the other direction of the first supporting member is supported by a seal provided inside the second supporting member,
the check valve ball is biased to the side in the other direction by a ball biasing spring between the communicating portion and the check valve ball, and movement of the check valve ball to the side in the other direction is restrained by a seal provided inside the second supporting member.
8. An ink container comprising:
the cap according to claim 7;
the spout; and
an ink pack integrally constituted with the spout to contain the ink.
9. An image forming apparatus comprising:
the ink container according to claim 8.
10. A cap comprising:
a cap body being attached to a spout of an ink container supplying an ink to one direction; and
a check valve having a check valve ball inside and preventing backward flow of the ink to the other direction,
wherein the cap body includes:
a first thread portion being screwed with an outer circumference face of the spout to seal the spout;
a supplying port being provided inside the first thread portion and having an inner diameter smaller than the spout; and
a second thread portion being provided around the supplying port inside the spout and extended from the cap body to the inside of the ink container,
the check valve is screwed with the second thread portion, and thereby, attached to the cap body from the inside of the ink container.
11. An ink container comprising:
the cap according to claim 10;
the spout; and
an ink pack integrally constituted with the spout to contain the ink.
12. An image forming apparatus comprising:
the ink container according to claim 11.

* * * * *